US008021740B2

(12) United States Patent
Wu

(10) Patent No.: US 8,021,740 B2
(45) Date of Patent: Sep. 20, 2011

(54) RADIATION CURABLE MASKANT AND LINE SEALER FOR PROTECTING METAL SUBSTRATES

(75) Inventor: Peter Hsiuen Wu, Wichita, KS (US)

(73) Assignee: The Boeing Company, Seattle, WA (US)

( * ) Notice: Subject to any disclaimer, the term of this patent is extended or adjusted under 35 U.S.C. 154(b) by 900 days.

(21) Appl. No.: 11/187,206

(22) Filed: Jul. 22, 2005

(65) Prior Publication Data

US 2008/0166545 A1 Jul. 10, 2008

Related U.S. Application Data

(62) Division of application No. 10/016,277, filed on Nov. 2, 2001, now Pat. No. 6,951,623.

(51) Int. Cl.
*B41M 5/00* (2006.01)

(52) U.S. Cl. ..... 428/195.1; 428/343; 428/346; 428/348; 428/432; 428/441; 428/385; 428/444; 428/404; 428/421; 428/422; 244/119

(58) Field of Classification Search ..... 244/119; 428/195.1, 343, 346, 348, 432, 441, 385, 428/444, 404, 421, 422
See application file for complete search history.

(56) References Cited

U.S. PATENT DOCUMENTS 3,297,745 A 1/1967 Fekete et al.
3,804,736 A 4/1974 Pasternack
4,042,476 A * 8/1977 Collins et al. ..... 427/514
4,180,598 A 12/1979 Emmons
4,585,519 A 4/1986 Jaffe et al.
4,716,270 A * 12/1987 Gnanamuthu et al. ... 219/121.85
4,869,778 A 9/1989 Cote
4,874,799 A * 10/1989 Hung et al. ..... 522/96
5,039,715 A 8/1991 Bachmann et al.
5,047,270 A * 9/1991 Mori et al. ..... 428/35.2
5,081,174 A 1/1992 VanBuskirk
5,126,005 A 6/1992 Blake
5,191,014 A 3/1993 Roberts et al.
5,212,271 A * 5/1993 Beckett et al. ..... 526/301
5,260,350 A 11/1993 Wright
(Continued)

FOREIGN PATENT DOCUMENTS

CA 2396806 A1 * 8/2001
(Continued)

OTHER PUBLICATIONS

Decker, C., Photoinitiated Crosslinking Polymerization, *Prog. Polym. Sci.*, 1996, pp. 593-650, vol. 21.

*Primary Examiner* — Bruce H. Hess
*Assistant Examiner* — Tamra L Amakwe
(74) *Attorney, Agent, or Firm* — Alston & Bird LLP

(57) ABSTRACT

The invention provides a coated metal substrate comprising a metal substrate having an outer surface, a maskant film adhered to at least a portion of the outer surface of the metal substrate, the maskant film having a pattern of scribed lines therein, and a line sealant composition applied to the scribed lines in a maskant film. Both the maskant film and the line sealant composition are preferably radiation cured and substantially solvent-free. The invention also provides a method of protecting a metal substrate from chemical exposure by utilizing the radiation-cured maskant film and line sealant composition.

40 Claims, 2 Drawing Sheets

U.S. PATENT DOCUMENTS 5,380,387 A 1/1995 Salamon et al.
5,388,754 A 2/1995 Grosclaude et al.
5,420,171 A 5/1995 Unruh
5,466,739 A 11/1995 Maeda et al.
5,571,570 A 11/1996 Lake
5,599,648 A * 2/1997 Kondo et al. ..... 430/256
5,695,659 A 12/1997 Dickie
5,773,487 A 6/1998 Sokol
5,800,695 A 9/1998 Kang et al.
5,945,462 A 8/1999 Salamon
6,045,032 A 4/2000 Longgood et al.
6,136,880 A 10/2000 Snowwhite et al.
6,251,963 B1 * 6/2001 Kohler et al. ..... 522/64
6,306,559 B1 * 10/2001 Tanamura et al. ..... 430/315
6,486,226 B2 * 11/2002 Al-Akhdar et al. ..... 522/18
6,602,643 B2 * 8/2003 Nikaidou et al. ..... 430/24
6,684,593 B2 * 2/2004 Brenneis et al. ..... 52/630
6,776,918 B1 * 8/2004 Yoshikawa et al. ..... 216/96

FOREIGN PATENT DOCUMENTS

GB 2 027 921 A 2/1980

* cited by examiner

RADIATION CURABLE MASKANT AND LINE SEALER FOR PROTECTING METAL SUBSTRATES

CROSS-REFERENCE TO RELATED APPLICATION

The present application is a divisional of application Ser. No. 10/016,277, filed Nov. 2, 2001 now U.S. Pat. No. 6,951,623, which is incorporated herein by reference in its entirety and for all purposes.

FIELD OF THE INVENTION

The invention is directed to materials and processes for protecting metal substrates from chemical exposure.

BACKGROUND OF THE INVENTION

In the aircraft and aerospace industries, chemical milling techniques are utilized to selectively etch portions of a metal substrate, such as an aluminum aircraft fuselage panel, in order to form a lightweight structure. In a conventional chemical milling procedure, a maskant is applied to the outer surfaces of the substrate. Conventional maskant formulations are cured by drying to form a chemical-resistant coating. After the maskant composition is cured, a pattern of lines is scribed into the maskant using a laser or a sharp instrument, such as a knife. The scribed lines define "cut-out" portions of the maskant that may be peeled away from the metal substrate in order to expose selected portions of the metal substrate. After a portion of the maskant is removed, the substrate is exposed to an etching solution. Thereafter, additional portions of the maskant may be removed and the etching process repeated.

For process efficiency, it is generally desirable to scribe all of the lines into the maskant film at one time. However, when the etching process comprises multiple stages with certain portions of the maskant being removed at each stage, the presence of the scribed lines can lead to penetration of the etching solution through the maskant in undesirable areas. To avoid this, conventional chemical milling processes include application of a line sealant composition to all of the scribed lines prior to removing portions of the maskant for chemical etching. The line sealant composition protects the metal substrate from chemical exposure in areas where the maskant "cut-out" has not yet been removed.

The water-based or organic solvent-based maskant and line sealant compositions conventionally used to protect the metal substrate during chemical milling processes suffer from a number of disadvantages. For example, conventional line sealant compositions typically last only one to two hours and have a fairly high failure rate, meaning the sealant composition allows the etching solution to penetrate to the metal substrate in undesired locations. In addition, the solvent-based maskant and line sealer compositions are toxic, resulting in increased process cost to address environmental and worker safety issues. Further, the high failure rate of conventional line sealant compositions necessitates the application of multiple line sealant coatings, which also increases process cost and reduces process efficiency. The conventional maskant and line sealer coatings also require drying times that are undesirably long, particularly in high humidity environments. It can take three to four hours or even longer to dry the line sealant and maskant compositions, which further delays the chemical milling process.

There is a need in the art for better methods of protecting metal substrates from chemical exposure during treatments such as chemical milling processes.

SUMMARY OF THE INVENTION

The present invention provides maskant and line sealant compositions that are substantially solvent-free and curable by actinic radiation. The coating compositions of the present invention provide better protection of metal substrates and can increase the process efficiency of chemical milling by reducing curing times and reducing the need for reapplication. In addition, the compositions of the invention pose few toxicity or environmental concerns because the use of solvents is avoided.

The present invention provides a method of protecting selected portions of a metal substrate from chemical exposure by applying a maskant coating composition to at least a portion of the surface of a metal substrate, the maskant composition being radiation curable and substantially solvent-free. The coated substrate is exposed to actinic radiation in order to cure the maskant composition and form a cured peelable maskant film adhered to the metal substrate. Thereafter, the coated substrate may be subjected to a chemical treatment, such as chemical milling. The maskant composition preferably comprises at least one polymerizable monomer or oligomer, at least one photoinitiator, and at least one filler. Examples of suitable polymerizable monomers or oligomers include acrylates, diacrylates, and urethane acrylates or diacrylates. An exemplary filler is talc.

Preferably, the maskant composition is cured by exposing the coated substrate to ultraviolet radiation, black light radiation or visible light radiation. In one embodiment, the exposing step comprising exposing the coated substrate to ultraviolet radiation by moving the substrate past at least one ultraviolet light or moving the ultraviolet light past the substrate. Typically, the coated substrate can be cured at a rate of about 1 to about 10 feet of substrate per minute. The final thickness of the cured maskant film is preferably about 5 to about 20 mils. Examples of suitable methods of application of the maskant compositions include spraying the composition onto the metal substrate, applying the composition with a roller or a blade, or dipping the substrate in the maskant composition.

In one embodiment, a substantially planar metal substrate panel is suspended by attaching the metal substrate to a frame and both sides of the substrate are sprayed with the maskant composition while the substrate is suspended. Thereafter, the coating composition on both sides of the metal substrate may be cured in a single step. In another embodiment, the substantially planar metal substrate panel may be coated without the added process step of suspending the substrate. In this method, the substrate is coated one side at a time. The maskant coating composition is applied to at least a portion of the first side of the metal substrate and, thereafter, the first coated side of the substrate is exposed to radiation to cure the maskant composition and form the peelable maskant film. The substrate can then be turned over and the maskant coating composition can be applied and cured on the second side of the metal substrate.

The present invention also provides a method of protecting selected portions of a metal substrate from chemical exposure by utilizing a line sealant composition that is radiation curable and substantially solvent-free. The method includes applying a maskant coating composition to at least a portion of the surface of metal substrate and curing the maskant coating composition to form a peelable maskant film. In this embodiment, it is preferable, but not required, to use a radiation curable maskant coating composition.

Following curing of the maskant composition, a predetermined pattern of lines is scribed into the maskant film, the scribed lines outlining portions of the maskant film to be removed. Thereafter, the radiation curable and substantial solvent-free sealant composition is applied to the scribed lines in the maskant film. The coated line sealant composition is then exposed to actinic radiation for curing. Once the line sealant composition is cured, portions of the maskant film outlined by the scribed lines may be peeled away from the metal substrate and the coated substrate may be subjected to chemical treatment, such as chemical milling, anodizing or deoxidizing.

The line sealant composition preferably comprises at least one polymerizable monomer or oligomer, at least one photoinitiator, and, optionally, one or more fillers or other ingredients. Examples of the polymerizable monomer or oligomer include acrylates, diacrylates, and urethane acrylates or diacrylates. Exemplary other ingredients include wax and synergists.

The present invention also provides a coated metal substrate comprising a metal substrate having an outer surface, a maskant film adhered to at least a portion of the outer surface of the metal substrate, the maskant film having a pattern of scribed lines therein, and a radiation cured and substantially solvent-free line sealant applied to the scribed lines in the maskant film.

BRIEF DESCRIPTION OF THE DRAWINGS

Figure 1:
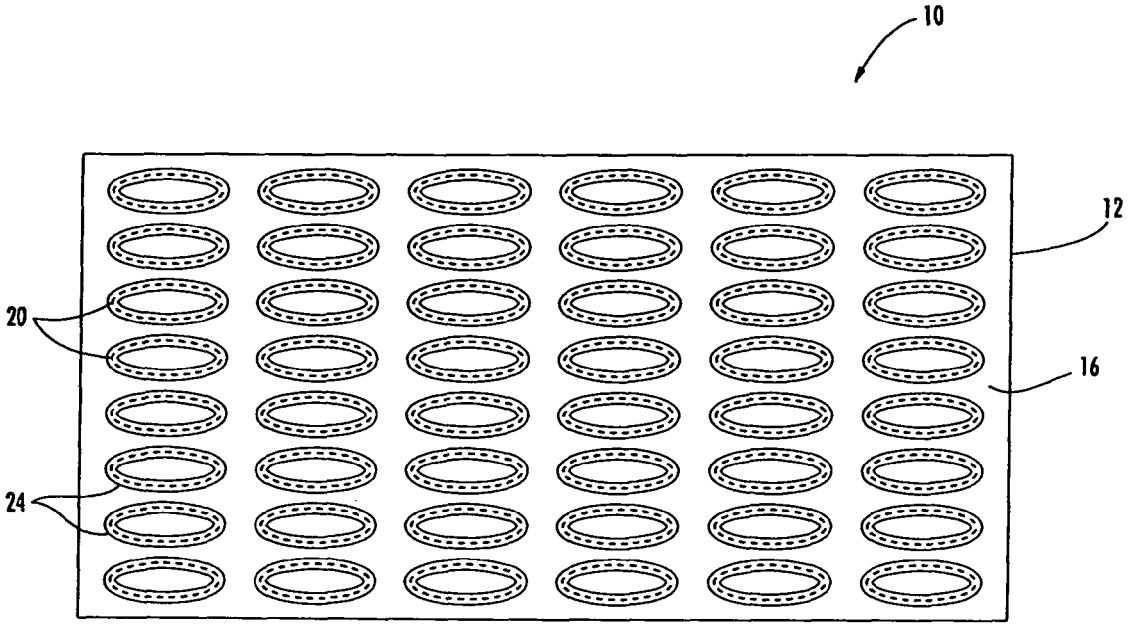
Figure 2:
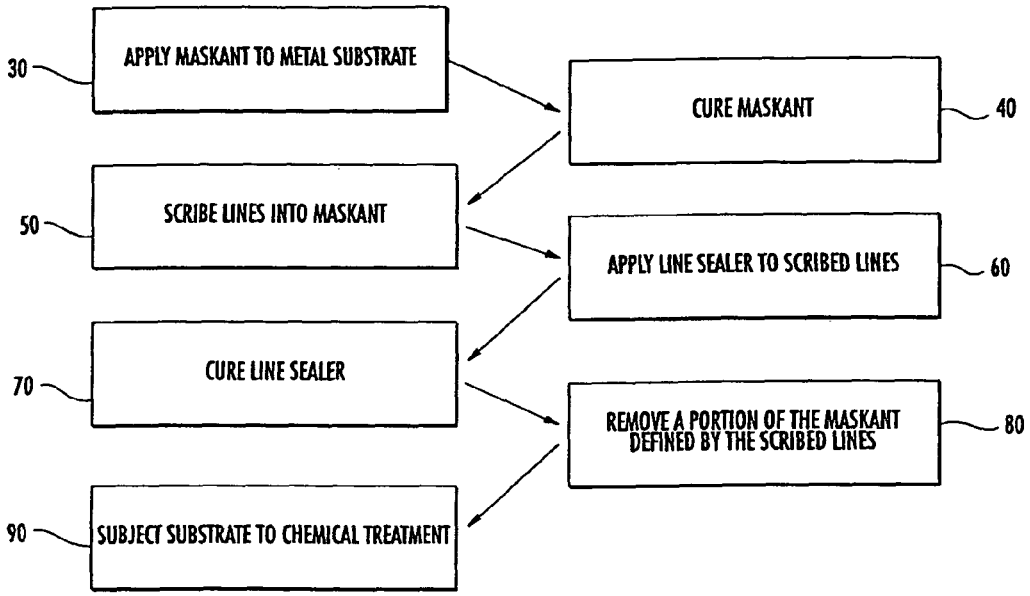

Having thus described the invention in general terms, reference will now be made to the accompanying drawings, which are not necessarily drawn to scale, and wherein:

FIG. 1 is a side view of a metal substrate having a maskant film applied thereto, wherein lines have been scribed in the maskant film and sealed with the line sealer of the invention; and FIG. 2 is a flowchart of a preferred process of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention provides coated metal substrates and methods of protecting selected portions of metal substrate from chemical exposure. As shown in FIG. 1, the present invention provides a coated metal article 10 comprising a metal substrate 12 having a maskant film 16 adhered to at least a portion of the outer surface of the metal substrate. A pattern of lines 20 has been scribed into the maskant film 16. A line sealant composition 24 overlies the scribed lines 20 in the maskant film 16. The metal substrate 12 may be constructed of any metal, such as aluminum, steel, titanium, or alloys thereof. Although the present invention is particularly advantageous for use in chemical milling processes for aluminum aircraft fuselage panels or "skins", other metal substrates that require protection from chemical treatments will also benefit from the present invention.

The maskant film 16 of the present invention is preferably a radiation-cured and substantially solvent-free film. The term "substantially solvent-free" is intended to encompass any "100% solids" composition, wherein the composition is substantially free of water or volatile organic solvents that evaporate from the composition during curing. The use of a substantially solvent-free maskant film reduces the toxicity of the composition and greatly reduces environmental and worker safety issues associated with its use.

The coating composition used to create the maskant film 16 of the present invention preferably includes one or more polymerizable monomers or oligomers. The oligomers or monomers are preferably selected from the group consisting of acrylates, diacrylates, and urethane acrylates or diacrylates. Specific preferred monomers or oligomers include isobornyl acrylate (SARTOMER SR506), isooctyl acrylate (SARTOMER 440), aliphatic urethane acrylate, aliphatic polyester-based urethane acrylate (SARTOMER CN965), aromatic urethane acrylate (SARTOMER CN-973J75), siliconized urethane acrylate (SARTOMER CN990), polybutadiene urethane diacrylate (SARTOMER CN 302), and mixtures thereof. The above-described SARTOMER monomers and oligomers are commercially available from Sartomer Company of Exton, Pa. Preferably, the monomers and/or oligomers are present in the composition at a total concentration of about 75 to about 95 weight percent.

The composition further includes a photoinitiator capable of reacting with the polymerizable monomer and/or oligomer components of the composition upon exposure to actinic radiation. The selection of photoinitiator determines the frequency range at which the composition is curable. Suitable photoinitiators include 1-hydroxycyclohexyl phenyl ketone (IRGACURE 184), mixtures of bis(2,6-dimethoxybenzoyl)-2,4-,4-trimethylpentyl phosphine oxide and 2-hydroxy-2-methyl-1-phenyl-propan-1-one (IRGACURE 1700), mixtures of trimethylbenzophenone and methylbenzophenone (ESACURE TZT), bis acyl phosphine oxide (IRGACURE 819), and mixtures thereof. The above-described IRGACURE and ESACURE photoinitiators are commercially available from Ciba of Tarrytown, N.Y. and Sartomer Company of Exton, Pa., respectively. The photoinitiator triggers polymerization and cross-linking of the monomers and/or oligomers present in the composition. Preferably, the photoinitiator is present in an amount of about 1 to about 10 weight percent.

The coating composition that forms the cured maskant film 16 also preferably includes at least one filler, such as talc or treated fumed silica. Other suitable fillers known in the art could also be used. The filler is preferably present in an amount of about 4 to about 15 weight percent.

Although other types of actinic radiation may be utilized, it is preferable to cure the maskant film 16 at between about 60° F. and about 120° F. using ultraviolet, visible light or black light radiation. In a particularly preferred embodiment, an ultraviolet radiation source having a wavelength of about 200 to about 500 nm, preferably about 200 to about 450 nm, and an intensity of about 100 W/cm$^2$ to about 600 W/cm$^2$, preferably about 120 W/cm$^2$ to about 185 W/cm$^2$, is used to cure the maskant composition. It is preferable for the radiation source to be substantially perpendicular to the substrate during curing. The cured maskant film 16 preferably has a thickness of about 5 to about 20 mils, more preferably about 8 to about 12 mils.

Once cured, the maskant 16 comprises a polymer component, such as poly(acrylates), poly(diacrylates), poly(urethane acrylates or diacrylates), and mixtures thereof. Specific examples of the polymer component of the maskant 16 include poly(isobornyl acrylate), poly(isooctyl acrylate), poly(aliphatic urethane acrylate), poly(aliphatic polyester-based urethane acrylate), poly(aromatic urethane acrylate), siliconized poly(urethane acrylate), polybutadiene urethane diacrylate, and mixtures thereof.

The maskant film 16 must be peelable so that selected portions thereof may be removed during the chemical milling process. Preferably, the maskant film 16 of the present invention exhibits a peel strength of about 3 oz./inch to about 30 oz./inch, more preferably about 3 oz./inch to about 10 oz./inch. In addition, it is important that the maskant film 16 exhibit chemical resistance to chemical treatments, such as strong acid or alkaline solutions (e.g. etching solutions used in chemical milling processes), so that seepage of the chemical reagents underneath the maskant does not occur. Preferably, the maskant composition is subjected to a vacuum and/or vigorously stirred and heated prior to application in order to remove any entrapped air. Air bubbles in the composition can lead to failure of the cured film during chemical exposure.

The line sealant 24 is also preferably a radiation cured and substantially solvent-free composition. The line sealant 24 should not adversely impact the ability to peel away portions of the maskant film 16 defined by the scribed lines 20. Additionally, it is important that the line sealant 24 exhibit chemical resistance to chemical treatments in the same manner as the maskant 16. Precautions similar to those described in connection with the maskant film 16 composition should be taken in order to remove entrapped air from the line sealant 24 composition prior to application.

The line sealant 24 is formed from a curable composition similar to the curable compositions described above for the maskant film 16. The line sealant 24 is formed from a composition comprising one or more polymerizable monomers and/or oligomer components, one or more photoinitiators, and one or more fillers or other ingredients, such as wax or synergists. The polymerizable monomer and/or oligomer components are typically selected from the group consisting of acrylates, diacrylates, and urethane acrylates or diacrylates. Particularly preferred monomers and oligomers include isobornyl acrylate (SARTOMER SR506), isooctyl acrylate (SARTOMER 440), urethane acrylate (SARTOMER CN973J75 or SARTOMER CN 964), and mixtures thereof. As with the maskant film 16 composition, the choice of photoinitiator will determine the frequency range at which the composition may be cured. Preferred photoinitiators include 1-hydroxycyclohexyl phenyl ketone (IRGACURE 184), bis acyl phosphine oxide (IRGACURE 819), and mixtures thereof.

Ultraviolet radiation-curable line sealant 24 compositions preferably comprise about 75 to about 95 weight percent of one or more polymerizable monomers and/or oligomers, about 4 to about 15 percent of one or more photoinitiators, and about 1 to about 10 percent of one or more fillers. A visible light/black light curable line sealant 24 composition preferably comprises about 75 to about 95 weight percent of one or more polymerizable monomers and/or oligomers, about 1 to about 10 percent of one or more photoinitiators, about 1 to about 15 percent of a wax component, such as a low melt paraffin wax, and about 0.1 to about 1 percent of one or more synergists, such as triethanolamine. The synergist component reduces the activation energy required to cure the composition, which is helpful in increasing the rate of curing when relying on black light or visible light radiation sources. The wax component inhibits the passage of oxygen into the composition, which reduces the loss of free radicals in the composition to oxidation and improves the rate of curing.

The line sealant 24 is preferably cured by actinic radiation, such as ultraviolet radiation, visible light radiation or black light radiation, at room temperature. The range of wavelength of the radiation source is typically between about 200 nm to about 500 nm, with an intensity of about 100 W/cm$^2$ to about 600 W/cm$^2$. For the ultraviolet curable compositions, the wavelength is generally about 200 to about 350 nm and the curing time is generally about 5 seconds to about 20 minutes. For the visible light/black light curable compositions, the wavelength is generally about 380 to about 450 nm and the curing time is generally about 2 minutes to about 10 minutes. In one embodiment, the line sealant composition is cured by exposing the line sealant to one or more 600 W fusion ultraviolet bulbs emitting wavelengths of about 200 to about 450 nm for about twenty minutes. In another embodiment, the line sealant is cured by exposing the sealant composition to a low intensity, low energy ultraviolet radiation source, such as one or more 40 W fluorescent bulbs emitting radiation at a wavelength of about 365 to about 410 nm for about twenty minutes. In yet another embodiment, the line sealant composition is cured by exposing the composition to a high intensity, low energy ultraviolet radiation source, such as a 400 W black light emitting radiation in the range of about 365 to about 410 nm for about ten minutes. Although less preferred, it is also possible to cure the sealant composition using visible light by exposing the sealant composition to one or more 400 W metal halide bulbs emitting radiation at a wavelength of about 420 to about 430 nm for about twenty minutes. The final thickness of the cured line sealant 24 is preferably about 6 mils to about 15 mils.

Once cured, the line sealant 24 comprises a radiation-cured polymer component, such as poly(acrylates), poly(diacrylates), poly(urethane acrylates or diacrylates), and mixtures thereof. Specific examples of suitable polymer components for the line sealant 24 include poly(isobornyl acrylate), poly (isooctyl acrylate), poly(urethane acrylate), and mixtures thereof.

The present invention also provides a method of protecting selected portions of a metal substrate from chemical exposure utilizing the above-described maskant and line sealant compositions. A flowchart of a preferred method of the invention is illustrated in FIG. 2. As shown, the first step 30 is to apply a maskant composition to at least a portion of the surface of the metal substrate, preferably the entire surface of the substrate. Preferably, as described above, the maskant composition is radiation curable and substantially solvent-free. The maskant composition may be applied to the substrate by spraying the composition onto the substrate, applying the composition with a roller, applying the composition with a blade, or by dipping the substrate into the maskant composition.

In a method of application particularly suited for substantially planar panels, the metal substrate can be suspended from a metal frame such that both sides of the metal substrate can be coated at the same time. The maskant composition is then sprayed onto both sides of the substrate and cured 40 in a single step. Alternatively, the maskant composition is coated 30 and cured 40 on one side of the substantially planar metal substrate panel at a time. In this method, the maskant coating composition is applied 30 to at least a portion of a first side of the metal substrate. Thereafter, the first coated side of the substrate is exposed to actinic radiation to cure 40 the maskant composition and form a cured peelable maskant film adhered to the first side of the substrate. The metal substrate 12 is then flipped over to expose the remaining uncoated side and the above process is repeated.

As noted above, the curing step 40 typically comprises exposing the coated substrate to ultraviolet, black light or visible light radiation. The method of exposure may comprise moving the coated substrate past at least one actinic radiation source or moving the radiation source past the substrate. For example, a bank of radiation-emitting bulbs can be moved over the surface of substrate to initiate curing. Alternatively, the coated substrate can be placed in a curing chamber and exposed to a plurality of radiation-emitting bulbs positioned within the chamber. The curing process is typically conducted at a rate of about 1 to about 10 feet of substrate per minute.

Once the masking composition is cured, a predetermined pattern of lines is scribed 50 into the maskant in order to define portions of the maskant that will be removed so that selected portions of the metal substrate can be exposed to chemical treatments, such as chemical milling. The lines may be scribed 50 into the maskant using any known technique in the art, such as by contacting the maskant composition with a sharp instrument (e.g. a knife). Alternatively, the lines may be scribed 50 into the maskant composition with a laser as described in U.S. Pat. No. 4,716,270, which is herein incorporated by reference in its entirety.

Once the lines are scribed 50 into the maskant, a line sealant composition is applied 60 to the scribed lines in order to prevent premature exposure of certain portions of the metal substrate to the chemical milling or other chemical treatment solutions. As described above, the line sealant composition is preferably radiation curable and substantially solvent-free. The line sealant composition is preferably applied 60 with a roller or cheesecloth. Once the line sealer is applied, the line sealant composition is cured 70 using an actinic radiation source, such as an ultraviolet or visible light radiation source as described above. Typically, the curing step 70 comprises exposing the sealant composition to ultraviolet radiation having a wavelength of about 200 to about 350 nm and an intensity of about 160 to about 240 W/cm$^2$ for a period of about 5 seconds to about 3 minutes. As described in connection with the maskant curing step 40 above, curing of the line sealant 70 can be accomplished in a variety of ways, including placing the line-sealed substrate in a curing chamber containing a plurality of radiation-emitting bulbs or moving the substrate past a bank of radiation-emitting bulbs.

Once the line sealant composition is cured 70, desired portions of the maskant film defined by the scribed lines may be removed 80 in order to expose selected portions of the metal substrate. Thereafter, the metal substrate can be subjected to a chemical treatment 90, such as chemical milling, deoxidizing, water rinsing, alkaline cleaning, or anodizing. In one embodiment, the chemical treatment step 90 comprises immersing the substrate in a chemical bath, such as a chemical milling etching solution. A conventional chemical milling etching solution comprises 32 oz./gal. of sodium hydroxide at 205° F. The steps of removing 80 portions of the maskant defined by the scribed lines and subjecting the substrate to a chemical treatment 90 can be repeated in a multiple-stage process that involves successive removal and treatment steps as desired. For example, most chemical milling processes involve repeatedly peeling away portions of the maskant film and exposing the substrate to an etching solution in order to obtain different degrees of etching in different areas of the substrate.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A coated metal substrate, comprising a metal substrate having an outer surface;

a maskant film adhered to at least a portion of the outer surface of said metal substrate, the maskant film having a pattern of scribed lines therein; and a radiation-cured and substantially solvent-free line sealant overlying said scribed lines in said maskant film.

2. The coated metal substrate of claim 1, wherein said line sealant comprises at least one radiation-cured polymer component.

3. The coated metal substrate of claim 2, wherein said at least one radiation-cured polymer component is selected from the group consisting of poly(acrylates), poly(diacrylates), poly(urethane acrylates or diacrylates), and mixtures thereof.

4. The coated metal substrate of claim 1, wherein said line sealant was cured by ultraviolet, black light or visible light radiation.

5. The coated metal substrate of claim 1, wherein said line sealant is formed by radiation curing of a radiation curable and substantially solvent-free line sealant composition comprising at least one polymerizable monomer or oligomer and a photoinitiator.

6. The coated metal substrate of claim 5, wherein said at least one polymerizable monomer or oligomer is selected from the group consisting of acrylates, diacrylates, urethane acrylates or diacrylates, and mixtures thereof.

7. The coated metal substrate of claim 5, wherein said at least one polymerizable monomer is selected from the group consisting of isobornyl acrylate, isooctyl acrylate, urethane acrylate, and mixtures thereof.

8. The coated metal substrate of claim 5, wherein said photoinitiator is selected from the group consisting of bis acyl phosphine oxide, 1-hydroxycyclohexyl phenyl ketone, and mixtures thereof.

9. The coated metal substrate of claim 1, wherein said line sealant comprises a wax and a synergist.

10. The coated metal substrate of claim 9, wherein said synergist is triethanolamine.

11. The coated metal substrate of claim 1, wherein said line sealant has a thickness of about 6 mils to about 15 mils.

12. The coated metal substrate of claim 1, wherein said maskant film is a radiation-cured and substantially solvent-free maskant film.

13. The coated metal substrate of claim 12, wherein said maskant film has a thickness of about 5 to about 20 mils.

14. The coated metal substrate of claim 13, wherein said maskant film has a thickness of about 8 to about 12 mils.

15. The coated metal substrate of claim 12, wherein said maskant film comprises at least one radiation-cured polymer component.

16. The coated metal substrate of claim 15, wherein said at least one radiation-cured polymer component is selected from the group consisting of poly(acrylates), poly(diacrylates), poly(urethane acrylates or diacrylates), and mixtures thereof.

17. The coated metal substrate of claim 12, wherein said maskant film is ultraviolet radiation cured.

18. The coated metal substrate of claim 12, wherein said maskant film further comprises a filler.

19. The coated metal substrate of claim 18, wherein said filler is selected from the group consisting of talc and fumed silica.

20. The coated metal substrate of claim 12, wherein said maskant film has a peel strength of about 3 oz./inch to about 30 oz./inch.

21. The coated metal substrate of claim 20, wherein said maskant film has a peel strength of about 3 oz./inch to about 10 oz./inch.

22. The coated metal substrate of claim 12, wherein said maskant film is formed by radiation curing of a radiation curable and substantially solvent-free maskant composition comprising at least one polymerizable monomer or oligomer and a photoinitiator.

23. The coated metal substrate of claim 22, wherein said at least one polymerizable monomer or oligomer is selected from the group consisting of acrylates, diacrylates, urethane acrylates or diacrylates, and mixtures thereof.

24. The coated metal substrate of claim 22, wherein said at least one polymerizable monomer or oligomer is selected from the group consisting of isobornyl acrylate, isooctyl acrylate, aliphatic urethane acrylate, aliphatic polyester-based urethane acrylate, aromatic urethane acrylate, siliconized urethane acrylate, polybutadiene urethane diacrylate, and mixtures thereof.

25. The coated metal substrate of claim 22, wherein said photoinitiator is selected from the group consisting of 1-hydroxycyclohexyl phenyl ketone, bis(2,6-dimethoxybenzoyl)-2,4-,4-trimethylpentyl phosphine oxide, 2-hydroxy-2-methyl-1-phenyl-propan-1-one, trimethylbenzophenone, methylbenzophenone, bis acyl phosphine oxide, and mixtures thereof.

26. The coated metal substrate of claim 1, wherein said metal substrate is selected from the group consisting of aluminum, steel, titanium, and alloys thereof.

27. The coated metal substrate of claim 1, wherein said metal substrate is an airplane fuselage panel.

28. The coated metal substrate of claim 1, wherein said line sealant and said maskant exhibit chemical resistance to a chemical treatment selected from the group consisting of chemical milling, anodizing, and deoxidizing.

29. A coated metal substrate, comprising a metal substrate having an outer surface;

a radiation-cured and substantially solvent-free maskant film adhered to at least a portion of the outer surface of said metal substrate, wherein said maskant film comprises a pattern of scribed lines therein; and further comprising a line sealant overlying said scribed lines in said maskant film.

30. The coated metal substrate of claim 29, wherein said metal substrate is selected from the group consisting of aluminum, steel, titanium, and alloys thereof.

31. The coated metal substrate of claim 29, wherein the metal substrate is an airplane fuselage panel.

32. The coated metal substrate of claim 29, wherein said maskant film exhibits chemical resistance to a chemical treatment selected from the group consisting of chemical milling, anodizing, and deoxidizing.

33. The coated metal substrate of claim 29, wherein said maskant film has a thickness of about 5 to about 20 mils.

34. The coated metal substrate of claim 29, wherein said maskant film comprises at least one radiation-cured polymer component.

35. The coated metal substrate of claim 34, wherein said at least one radiation-cured polymer component is selected from the group consisting of poly(acrylates), poly(diacrylates), poly(urethane acrylates or diacrylates), and mixtures thereof.

36. The coated metal substrate of claim 29, wherein said maskant film is formed by radiation curing of a radiation curable and substantially solvent-free maskant composition comprising at least one polymerizable monomer or oligomer and a photoinitiator.

37. The coated metal substrate of claim 36, wherein said at least one polymerizable monomer or oligomer is selected from the group consisting of acrylates, diacrylates, urethane acrylates or diacrylates, and mixtures thereof.

38. The coated metal substrate of claim 36, wherein said at least one polymerizable monomer or oligomer is selected from the group consisting of isobornyl acrylate, isooctyl acrylate, aliphatic urethane acrylate, aliphatic polyester-based urethane acrylate, aromatic urethane acrylate, siliconized urethane acrylate, polybutadiene urethane diacrylate, and mixtures thereof.

39. The coated metal substrate of claim 36, wherein said photoinitiator is selected from the group consisting of 1-hydroxycyclohexyl phenyl ketone, bis(2,6-dimethoxybenzoyl)-2,4-,4-trimethylpentyl phosphine oxide, 2-hydroxy-2-methyl-1-phenyl-propan-1-one, trimethylbenzophenone, methylbenzophenone, bis acyl phosphine oxide, and mixtures thereof.

40. A coated airplane fuselage panel, comprising:

a metal airplane fuselage panel having an outer surface;

a radiation-cured and substantially solvent-free maskant film adhered to at least a portion of the outer surface of said fuselage panel, said maskant film having a pattern of scribed lines therein; and a radiation-cured and substantially solvent-free line sealant overlying said scribed lines in said maskant film, wherein said maskant film and said line sealant exhibit chemical resistance to a chemical treatment selected from the group consisting of chemical milling, anodizing, and deoxidizing.

* * * * *